United States Patent [19]

Masui

[11] Patent Number: 4,780,078

[45] Date of Patent: Oct. 25, 1988

[54] TONER IMAGE THERMAL FIXATION ROLLER

[75] Inventor: Shintarou Masui, Nara, Japan

[73] Assignee: Sharp Kabushiki Kaisha, Osaka, Japan

[21] Appl. No.: 37,133

[22] Filed: Apr. 10, 1987

Related U.S. Application Data

[63] Continuation of Ser. No. 789,788, Oct. 21, 1985, abandoned.

[30] Foreign Application Priority Data

Oct. 22, 1984 [JP] Japan ..... 59-160711[U]

[51] Int. Cl.[4] ..... H05B 3/10; G03G 15/20

[52] U.S. Cl. ..... 432/60; 355/3 FU; 219/216; 219/469; 432/228

[58] Field of Search ..... 432/8–59, 432/60, 228; 219/469, 216; 355/3 FU

[56] References Cited

U.S. PATENT DOCUMENTS

| | | | |
|---|---|---|---|
| 4,063,066 | 12/1977 | Nagoshi | 219/469 |
| 4,063,530 | 12/1977 | Thetta et al. | 432/60 |
| 4,212,631 | 7/1980 | Franke et al. | 432/60 |
| 4,316,719 | 2/1982 | Motomura et al. | 432/60 |
| 4,372,246 | 2/1983 | Azar et al. | 355/3 FU |
| 4,550,243 | 10/1985 | Inagaki | 219/469 |

FOREIGN PATENT DOCUMENTS

| | | | |
|---|---|---|---|
| 57-111574 | 7/1982 | Japan | 219/469 |

*Primary Examiner*—Henry C. Yuen

*Attorney, Agent, or Firm*—Birch, Stewart, Kolasch & Birch

[57] ABSTRACT

Disclosed is a toner thermal fixing roller comprised of the following; a heating unit internally provided with a heating source: a roller pressed against said heating roller; and several member parts preventing reflective heat from heating the heating source, while these member parts are provided inside the bearing parts which are set to both ends of the heating source, the bearing parts being set to both ends of the heating roller and installed inside the hollow portion of the heating roller.

6 Claims, 2 Drawing Sheets

TONER IMAGE THERMAL FIXATION ROLLER

This application is a continuation-in-part, of application Ser. No. 789,788 filed on Oct. 21, 1985 now abandoned.

BACKGROUND OF THE INVENTION

The present invention relates to a roller for thermally and stably fixing a toner image on copy paper. Conventional electrophotographic copying machines and laser printers incorporating electronic photographing systems are already well known to the public. These devices cause the toner image of either draft pictures or recorded information to be generated on a photoreceptor which is the basic medium for recording pictures and information before the toner image is transferred onto copy paper. The toner image remains unfixed immediately after being transferred onto copy paper and is eventually fixed after passing through a toner fixation device. There are a variety of toner fixing devices. A roller which theremally fixes the toner image is widely popular. Of several rollers forming the thermal fixing roller unit, the surface of the roller coming into contact with the toner image on the copy paper is controlled so that it constantly maintains the proper toner fixable temperature throughout the copying operation. The thermal fixing roller is heated by a heater either inside or outside the thermal fixing roller. The heater is properly controlled so that the surface of the roller constantly maintains the proper toner fixable temperature. For example, the heater may be installed in the center of the rotary shaft so that the roller is heated by heat radiating from the heater. Normally, to improve the roller's efficiency in absorbing heat from the heater, the internal surface of the roller is coated with black paint. Normally, the black-coated portion is provided only along the internal surface of the roller to match the toner fixing external surface of the roller. In addition, to ensure a greater heating effect, either an infrared lamp or a halogen lamp is commonly used with the heater. The halogen lamp is made of a glass tube comprised of tungsten filaments with halogen sealed inside. Both ends of the glass tube are sealed flat. The externally connected terminals inside the sealed portion of the glass tube are electrically connected to filaments via metal foil such as molybdenum foil to feed electricity to the filaments. Normally, when a halogen lamp is provided inside the toner fixing roller, the externally-connected terminal of the heater lamp is arranged so that the terminal itself projects from the toner fixing roller. Thus, the sealed portion of the heater lamp is positioned so that the sealed portion is opposite to the roller bearing. The inner surface of the bearing at the end of the roller unit has a bare metal surface such as aluminum, which reflects infrared rays from the heater lamp. Some of the reflected beams reach the sealed portion of the halogen lamp in the center of the rotary shaft of the toner fixing roller. As a result, the sealed portion is heated. Since the sealed portion of the heater lamp is extremely vulnerable to heat, the heat adversely affects the service of the halogen lamp itself. Metal foils are also used in the sealed portion of the halogen lamp. In particular, of all the lamp components, molybdenum foil most easily causes oxidation to occur. Thus it can be cut off easily. The oxidation is promoted by heating and significantly shortens the service life of the lamp. The metal foil is easily heated by the infrared rays reflected from the halogen lamp, thus accelerating the disconnecting time of the heated portion and significantly shortening the service life of the heater lamp as well.

SUMMARY OF THE INVENTION

The present invention provides a useful toner thermal fixing roller capable of extending the service life of a halogen lamp without shortening the service life of the combination roller-heater lamp. Other objects and the further scope of the present invention's applicability will become apparent from the detailed description given herinafter. It should be understood, however, that the detailed description and specific examples, while indicating the preferred embodiments of the invention, are given by way of illustration only, since various changes and modifications within the spirit and scope of the invention will become apparent to those skilled in the art from the following detailed description. To realize the above objectives, the preferred embodiment of the present invention provides a toner thermal fixing unit comprised of a heating roller with an internal heating source, a roller pressed against the heating roller, and at least one member part for preventing reflective heat from reaching the heating source provided inside bearing parts of both ends of the heating roller.

BRIEF DESCRIPTION OF THE DRAWINGS

The present invention will be better understood from the detailed description given below and the accompanying drawings which are given by way of illustration only, and thus do not limit the present invention in which.

DETAILED DESCRIPTION OF THE PREFERRED EMBODIMENTS

Figure 1:
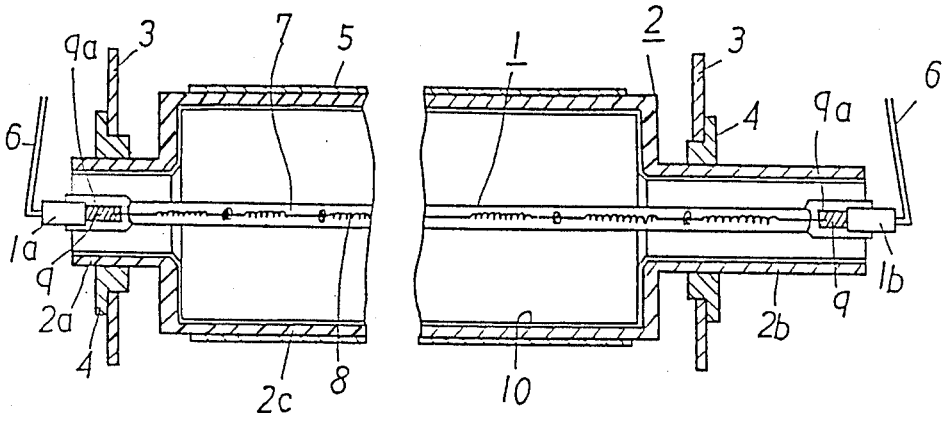
FIG. 1 is a longitudinal cross section of the configuration of the heating roller that makes up the toner thermal fixing unit incorporating the preferred embodiments of the present invention.
Figure 4:
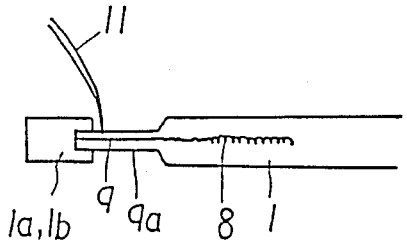
FIG. 4 is an example of a temperature measurement made in conjunction with the characteristic diagrams shown in FIG. 3.
Figure 2:
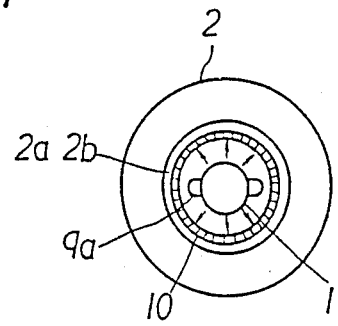
FIG. 2 is an end view of the heating roller.
Figure 5:
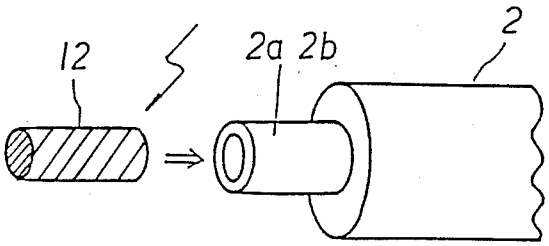
FIG. 5 is a perspective view of the toner thermal fixing roller representing another preferred embodiment of the present invention.
Figure 3:
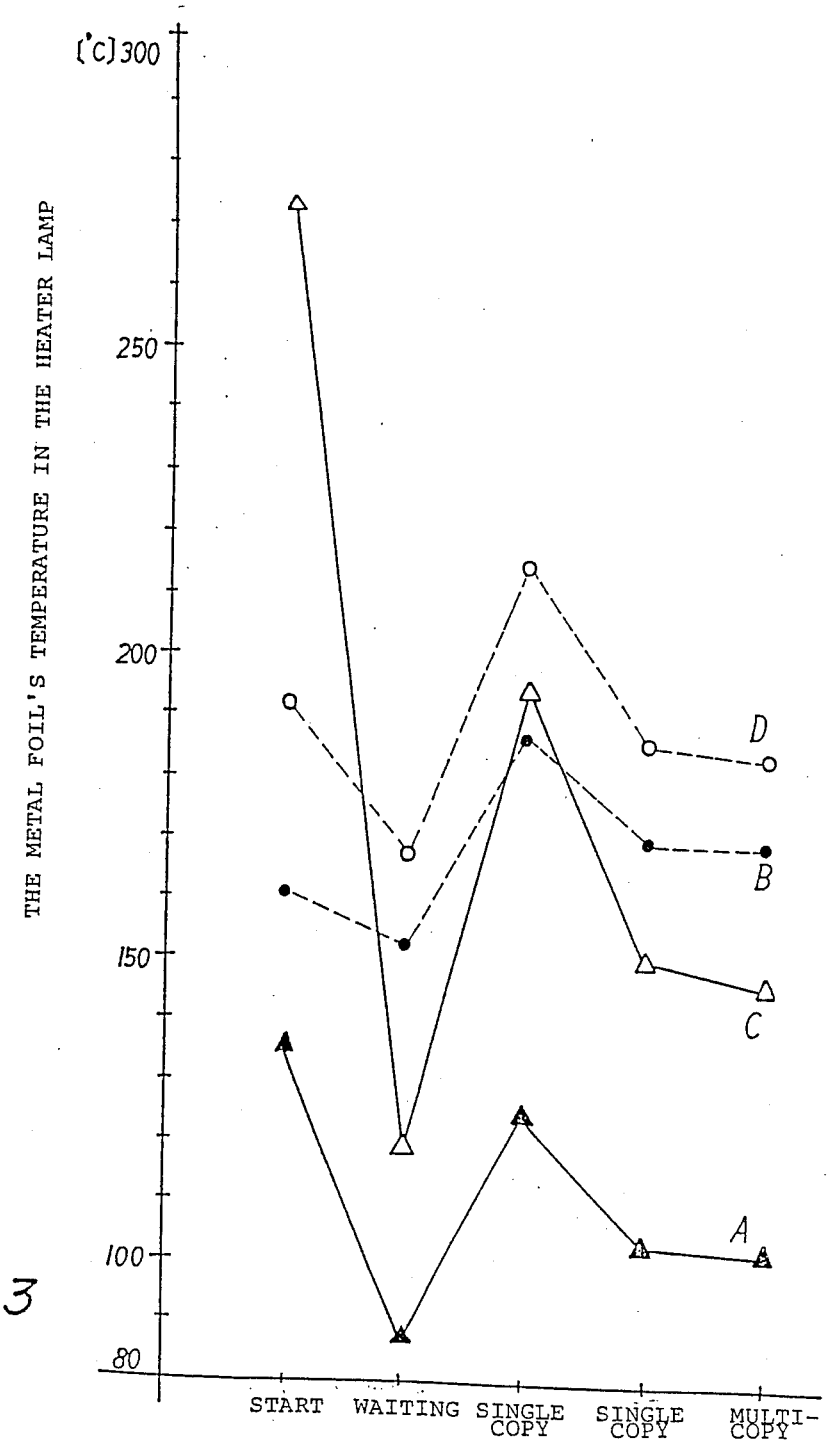
FIG. 3 is a graph showing the temperature of the metal foil in the heater lamp at the various stages of the copying operation.

FIG. 1 is a longitudinal cross section of the toner thermal fixing roller incorporating one of the preferred embodiments of the present invention. The heating roller (2) provided with a heater lamp (1) in the center of the shaft is held by the roller support members (3) via the bearings (4) through which the heating roller bearing parts (2*a* and 2*b*) respectively extend to both ends, thus allowing the heating roller (2) to freely rotate. In addition, there is a roller (not shown) which presses against the heating roller. Thus, the two rollers form the toner thermal fixing unit. The heating roller (2) is comprised of the cylindrical roller (2*c*) and an aluminum tube which is plastically formed together with the bearing parts (2*a* and 2*b*) to rotate the cylindrical roller (2*c*). Or, in the alternative, the heating roller (2) is formed by securing an independent roller body (2*c*) to the bearing parts (2*a* and 2*b*). The surface of the cylindrical roller (2*c*) of the heating roller (2) is provided with a layer (5) composed of Teflon resin, which adequately acts as a release for the toner. The heater lamp mentioned earlier is set in the center of the hollow rotary part of the heating roller (2). In FIG. 1, the lengthy bearing (2*b*) connected to the heating roller (2) is shown. This is because several gears conveying the rotation force are connected to the bearing (2*b*) (although no gear is shown in the figure). The externally-connected terminals (1*a*) and (1*b*) at both ends of the heater lamp (1) are supported by the spring force of the spring electrode (6), while the heater lamp itself is installed in the center of the heating roller (2). Electricity is connected between the terminals (1a and 1*b*) and filaments (8) sealed inside the glass tube (7) via the metal foil (9), such as molybdenum. The glass tube (7) which contains the metal foil (9) is pressed flat and sealed at the ends (9*a*). As a result, when power is supplied between the spring electrodes (6), the filaments (8) receive electricity and are illuminated to allow infrared rays to radiate throughout the internal space of the heating roller (2). The entire inner surface of the heating roller (2) is finished with a heat-resistant black coating (10), including the area corresponding to the roller (2*c*), and the area corresponding to the bearing parts (2*a* and 2*b*). This allows the infrared rays from the heater lamp (1) to be absorbed into the heating roller (2), particularly into the roller part (2*c*), so that the heating roller can be heated effectively. Likewise, such infrared rays radiated to the bearing parts (2*a* and 2*b*) of the heating roller (2) are effectively absorbed by the black-coated portion (10), thus preventing the metal foil (9) of the sealed portion (9*a*) of the heating lamp (1) from being heated adversely by concentrically reflected infrared rays. The ideal condition is shown in the end view of the system in FIG. 2. Consequently, no heat can be applied to the metal foil (9). Therefore, the system can prevent unwanted disconnection otherwise caused by the shortened service life of the metal foil (9). FIG. 3 is a graph showing the temperature of the metal foil in the heater lamp at various stages of the copying operation. In conjunction with the measurement of the metal foil's temperature, the inventors use a diamond cutter to form a groove in the glass tube (7) of the heater lamp (1). This is done before installing a thermocouple (11) into the groove directly contacting the metal foil (9). Finally, variations in the temperature of the metal foil (9) are measured. This is shown in FIG. 4. Referring to FIG. 3, C and D indicate the variations in temperature of the metal foil (9) of a conventional toner fixing roller. A and B indicate variations in the metal foil's temperature employed to implement the toner thermal fixing roller embodied by the present invention. A and C indicate the temperature of the metal foil (9) matching the position of the bearing (2*b*) of the heating roller (2). B and D indicate the temperature of the metal foil (9) matching the position of the bearing (2*a*) of the same heating roller (2). As is clear from the graph of FIG. 3, the preferred embodiment of the present invention causes the temperature of the metal foil (9) to be drastically lowered from that of the metal foil employed by the prior art, thus significantly extending the service life of the heating lamp (2) which would otherwise be shortened by disconnection of the metal foil (9). As described earlier, the preferred embodiment provides a black coating on the entire inner surface of the heating roller (2). However, another preferred embodiment allows insertion of a heat-resistant black collar (12) into the inner circumference of the bearing parts (2*a* and 2*b*) of the heating roller (2), as shown in FIG. 5. The black collar may be made of black-coated heat-resistant material. To realize the objective, not only the black-coated member, but all appropriate members that reliably inhibit the reflection of infrared rays and the heating of the sealed portion of the heater lamp may also be coated. According to one of the preferred embodiments of the present invention, to reliably prevent the temperature of the metal foil (9) of the heating lamp (2) from rising, the entire inner surface of the bearing parts (2*a* and 2*b*) are finished with a heat-resistant black coating. Therefore, the objectives of the present invention can be achieved even without applying the entire inner surface of the roller part (2*c*) matching the position of the toner fixing part with a black coating. In other words, the preferred embodiments of the present invention provide reflection-inhibiting members along the entire inner surface of the roller bearing parts and substantially extend the service life of the heating lamp (2). As is clear from the foregoing description, the toner thermal fixing roller embodied by the present invention provides a heating source in the core of the rotary shaft of the heating roller as well as reflection-inhibiting members along the inner surface of the bearing parts on both sides of the heating roller. The unique configuration prevents the heating of specific members connected to the filaments, for example, which form the sealed parts along the edge of the heating source. Thereby, the configuration allows the service life of the heating source to be significantly extended. Only certain embodiments of the present invention have been described. It will be apparent to those who are skilled in the art that various changes and modifications may be made therein without departing from the spirit and scope of the present invention as claimed.

What is claimed is:

1. A toner thermal fixing roller useful in a toner fixing device of an electronic photographic system comprising in combination:

a heating roller consisting essentially of a central hollow cylindrical rotary portion and two narrower hollow lateral bearing parts which rotate said central portion said central cylindrical portion having an outer surface coated with a release coating;

external terminals at each end of said heating roller within said lateral bearing parts of said heating roller;

a heating source provided internal to said hollow rotary portion of said heating roller connected to said external terminals at each end thereof by way of metal foils within said respective hollow lateral bearing parts; and a heat absorptive, reflection-inhibiting means provided on substantially the entire inner surface of said heating roller contiguous with substantially the entire inner surfaces of said hollow lateral bearing parts so as to retain the heat absorbed from said heating source, particularly with respect to said lateral bearing parts, so as to effectively prevent heat from varying the temperature of said metal foils and said heating source.

2. A toner thermal fixing roller as in claim 4, wherein said heat absorptive, reflection-inhibiting means consists of a heat-resistant black paint.

3. A toner thermal fixing unit as defined in claim 4, wherein said heat absorptive, reflection-inhibiting means within said hollow lateral bearing parts consists of heat-resistant black collars inserted into each of said lateral bearing parts.

4. The thermal fixing roller of claim 1, wherein said central hollow cylindrical rotary portion is an independent roller body connected to distinct lateral bearing parts.

5. A toner thermal fixing unit useful in an electronic photographic system comprising in combination:

a hollow heating roller consisting essentially of a central hollow cylindrical rotary portion terminating at respective ends as two hollow lateral bearing parts of reduced diameters as compared with said central cylindrical portion, said central cylindrical portion having an outer surface coated with a release coating;

external terminals at each end of said heating roller within said hollow lateral bearing parts of said heating roller;

a heating source provided internal to said heating roller connected to said external terminals at each end thereof via metal foils within said respective later bearing parts;

a heat absorptive, reflection-inhibiting means provided on substantially the entire inner surface of said heating roller contiguous with substantially the entire inner surfaces of said hollow lateral bearing parts of said heating roller which heat absorptive means functions to prevent heat from said heating source from varying the temperature of said metal foils and said heating source by retaining said heat absorbed from said heating source; and an external pressure roller which presses against the outer surface of said heating roller.

6. The toner thermal fixing unit of claim 5, wherein said heat absorptive, reflection inhibiting means of said lateral bearing parts consists of heat-resistant black collars inserted within the inner circumference of each of said hollow lateral bearing parts.

* * * * *